US007236075B1

(12) United States Patent
Liu

(10) Patent No.: US 7,236,075 B1
(45) Date of Patent: Jun. 26, 2007

(54) TRANSFORMER

(75) Inventor: Lu-Ta Liu, Taipei (TW)

(73) Assignee: Lankom Electronics Co., Ltd (TW)

( * ) Notice: Subject to any disclaimer, the term of this patent is extended or adjusted under 35 U.S.C. 154(b) by 0 days.

(21) Appl. No.: 11/326,490

(22) Filed: Jan. 6, 2006

(51) Int. Cl.
*H01F 27/02* (2006.01)

(52) U.S. Cl. ..... 336/90

(58) Field of Classification Search ..... 336/65, 336/83, 90, 92, 96, 196, 198
See application file for complete search history.

(56) References Cited

U.S. PATENT DOCUMENTS 4,047,061 A * 9/1977 Kilmer et al. ..... 310/164
4,656,450 A * 4/1987 Jarosz et al. ..... 336/83
5,805,431 A * 9/1998 Joshi et al. ..... 361/836
6,922,130 B2 * 7/2005 Okamoto ..... 336/208
6,982,619 B2 * 1/2006 Nussio ..... 335/262

* cited by examiner

*Primary Examiner*—Tuyen T. Nguyen
(74) *Attorney, Agent, or Firm*—Hershkovitz & Associates; Abe Hershkovitz

(57) ABSTRACT

A transformer has a cover and a bobbin. The cover has a cavity and a bottom opening. The cavity is formed inside of the over. The bobbin is mounted inside the cavity in the cover and has two surfaces, multiple pins and multiple coils. The pins are mounted through the bobbin and protrude from the two surfaces of the bobbin. The coils are mounted between the pins and have wires connected to each other. After the coils are connected to pins and tested, the bobbin with the coils can be mounted in the cover so that the process of fabricating the transformer is easier.

5 Claims, 7 Drawing Sheets

TRANSFORMER

BACKGROUND OF THE INVENTION

1. Field of the Invention

The present invention relates to a transformer, and more particularly to a transformer that is easy to manufacture.

2. Description of Related Art

Transformers are widely used in many electrical devices. The transformers are able to change voltage from high to low or from low to high so transformers are a very important part in many electrical devices.

With reference to FIGS. 6, 7 and 8, a conventional transformer comprises a cover (30, 40), multiple pins (32, 43), coils (33, 44) and encapsulant (46).

The cover (30, 40) has a top, a top opening (not numbered) and a cavity (31, 41). The top opening is formed on the top of the cover (30, 40). The cavity (31, 41) is formed in the cover (30, 40) and communicates with the top opening of the cover (30, 40) and has a bottom and multiple optional through holes (42). The through holes (42) are formed through the bottom of the cover (40) and correspond to each other.

The pins (32, 43) are mounted in and protrude from the cover (30,40). In a first embodiment of the conventional transformer, the pins (32) protrude through the top opening in the cover (30). In a second embodiment, the pins (43) are mounted respectively in the through holes (42) through the bottom of the cover (40), extend into the cavity (41) and protrude from the bottom of the cavity (41).

The coils (33, 44) are located inside the cavity (31, 41) and have wires (34, 45). The wires (34, 45) connect the coils (33, 44) respectively to the pins (32, 43).

The encapsulant (46) fills the cavity (31, 41) in the cover (30, 40) to seal the top opening and the cavity (31, 41) and protect the coils (33, 44).

The encapsulant (46) keeps manufacturing the transformers from being less expensive. Furthermore, the encapsulant (46) must be removed totally to correct any internal problem with the transformers. Removing and replacing the encapsulant (46) keeps manufacturing the transformers from being easy.

To overcome the shortcomings, the present invention provides a transformer to obviate or mitigate the aforementioned problems.

SUMMARY OF THE INVENTION

The primary objective of the present invention is to provide a transformer that is easy to manufacture.

The transformer in accordance with the present invention has a cover and a bobbin. The cover has a cavity and a bottom opening. The cavity is formed inside of the cover. The bobbin is mounted inside the cavity of the cover and has two surfaces, multiple pins and multiple coils. The pins are mounted through the bobbin and protrude from the two surfaces of the bobbin. The coils are mounted between the pins and have wires connecting to appropriate pins and coils. After the coils are connected to pins and tested, the bobbin with the coils can be mounted in the cover so that the process of fabricating the transformer is easier. Furthermore, the transformers do not need encapsulant to seal so that materials of transformers can be reduced and cost of the transformers can be lower.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
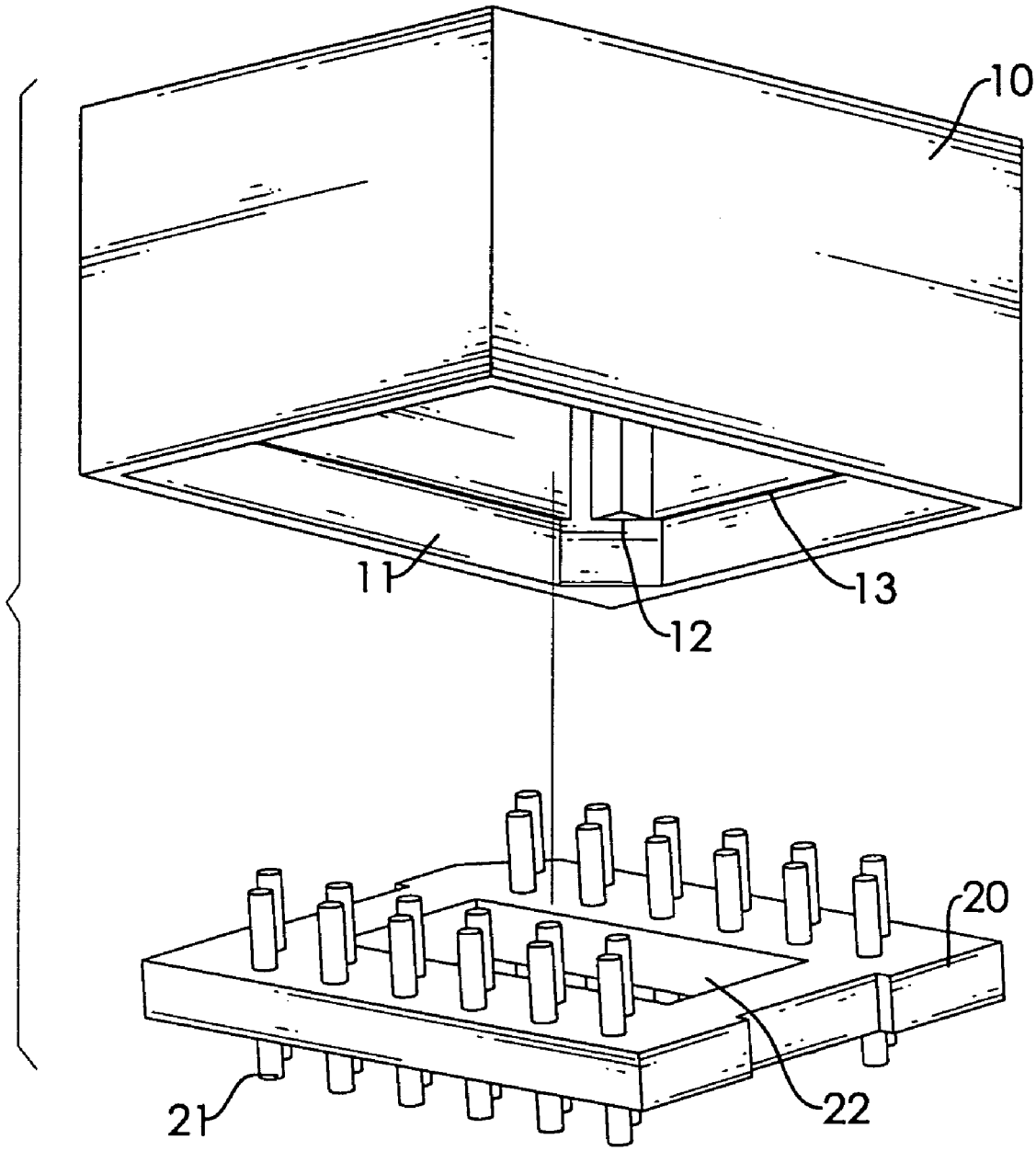
FIG. 1 is an exploded perspective view of a first embodiment of a transformer without coils in accordance with the present invention.

With reference to FIGS. 1, 3, 4 and 5, a transformer in accordance with the present invention has a cover (10, 10A, 10B, 10C) and a bobbin (20, 20A, 20B, 20C).

The cover (10, 10A, 10B, 10C) has a bottom, a bottom opening and a cavity (11, 11A, 11B, 11C). The bottom opening is formed on the bottom of the cover (10, 10A, 10B, 10C). The cavity (11, 11A, 11B, 11C) is formed inside the cover (10, 10A, 10B, 10C), comminutes with the bottom opening of the cover (10, 10A, 10B, 10C) and has inside walls, at least one corner protrusion (12, 12A, 12B, 12C) and at least one protruding edge (13, 13A, 13B, 13C). The at least one corner protrusion (12, 12A, 12B, 12C) is formed on at lease one of the inside walls of the cavity (11, 11A, 11B, 11C). The at least one protruding edge (13, 13A, 13B, 13C) is formed on at lease one of the inside walls of the cavity (11, 11A, 11B, 11C).

Figure 2:
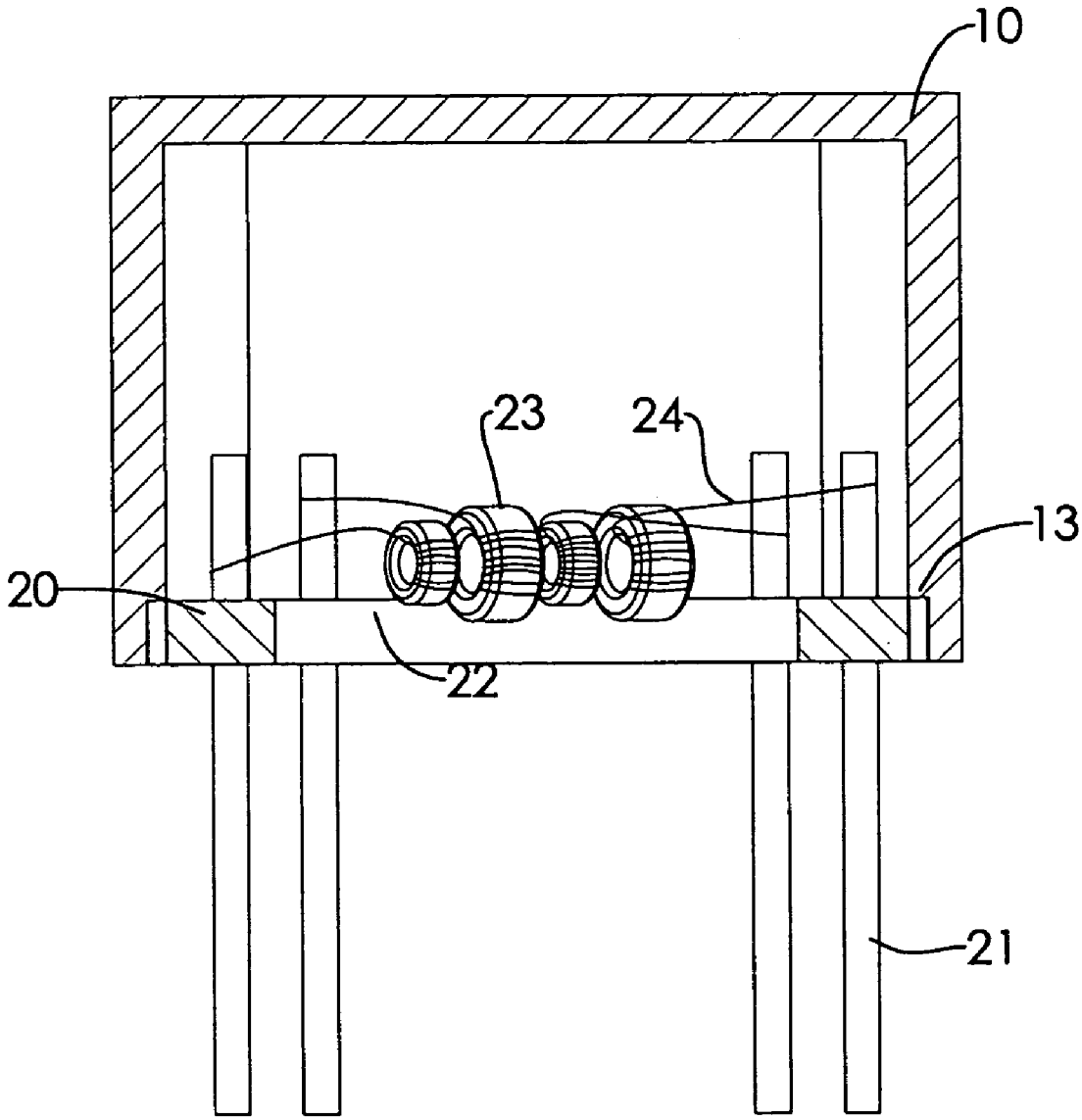
FIG. 2 is a cross section side view of the transformer in FIG. 1 with coils.

With further reference to FIG. 2, the bobbin (20, 20A, 20B, 20C) is mounted inside the cavity (11, 11A, 11B, 11C) of the cover (10, 10A, 10B, 10C) and has two surfaces, engaging edges, multiple pins (21, 21A, 21B, 21C), an opening (22, 22A, 22B, 22C) and multiple coils (23). The engaging edges attach respectively to the at least one corner protrusion (12, 12A, 12B, 12C) and the at least one protruding edge (13, 13A, 13B, 13C) to mount the bobbin (20, 20A, 20B, 20C) in the cover (10, 10A, 10B, 10C). Furthermore, encapsulant may be used between the engaging edges of the bobbin (20, 20A, 20B, 20C), the at least one corner protrusion (12, 12A, 12B, 12C) of the cover (10, 10A, 10B, 10C) and the at least one protruding edge (13, 13A, 13B, 13C) of the cover (10, 10A, 10B, 10C) to attach the bobbin (20, 20A, 20B, 20C) securely to the cover (10, 10A, 10B, 10C). The pins (21, 21A, 21B, 21C) are mounted through the bobbin (20, 20A, 20B, 20C) and protrude from the two surfaces of the bobbin (20, 20A, 20B, 20C).

In a first embodiment of the transformer in accordance with the present invention, with reference to FIG. 1, the bobbin (20) has 24 pins (21).

Figure 3:
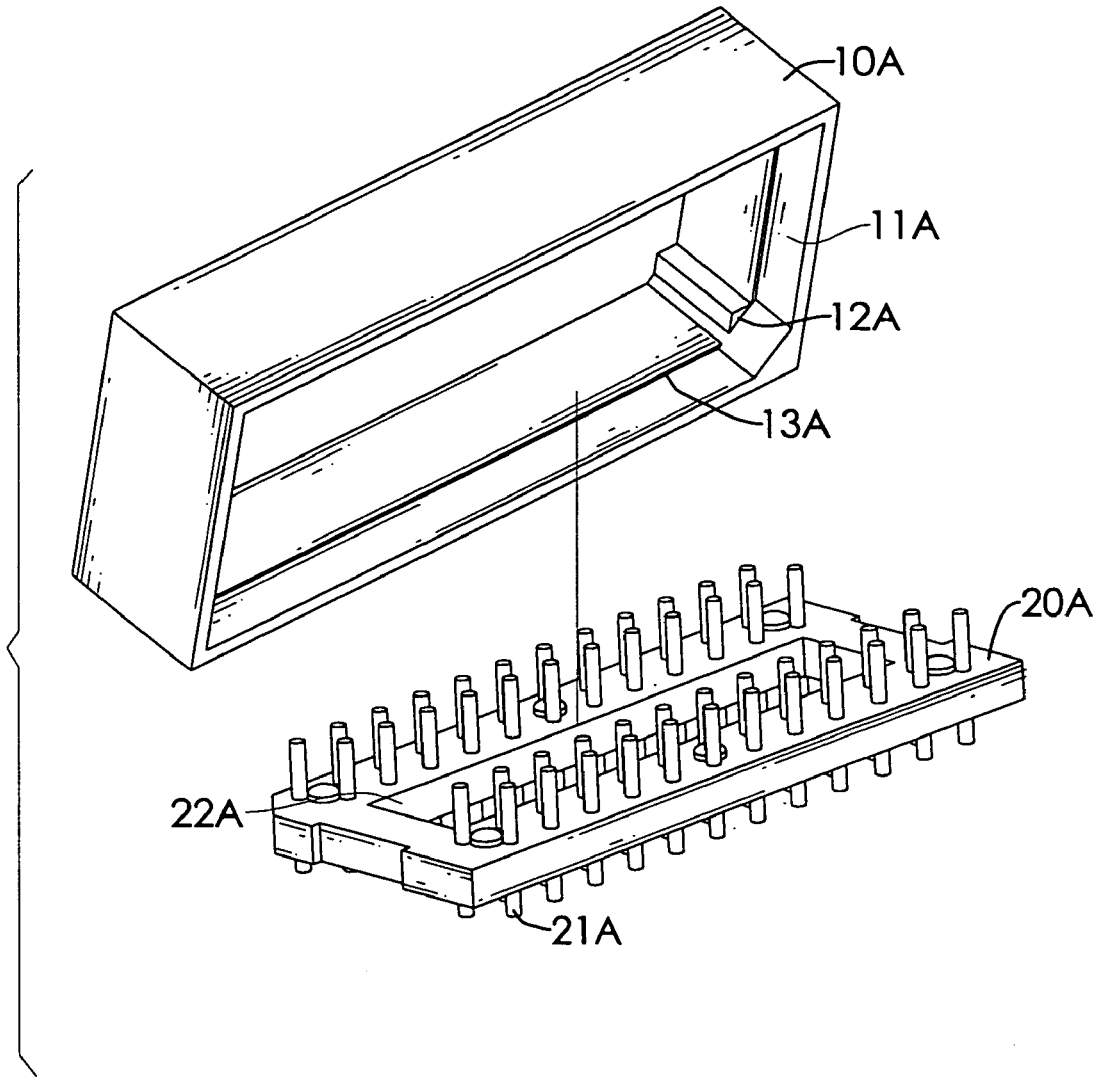
FIG. 3 is an exploded perspective view of a second embodiment of the transformer without coils in accordance with the present invention.

In a second embodiment of the transformer in accordance with the present invention, with reference to FIG. 3, the bobbin (20A) has 48 pins (21A).

Figure 4:
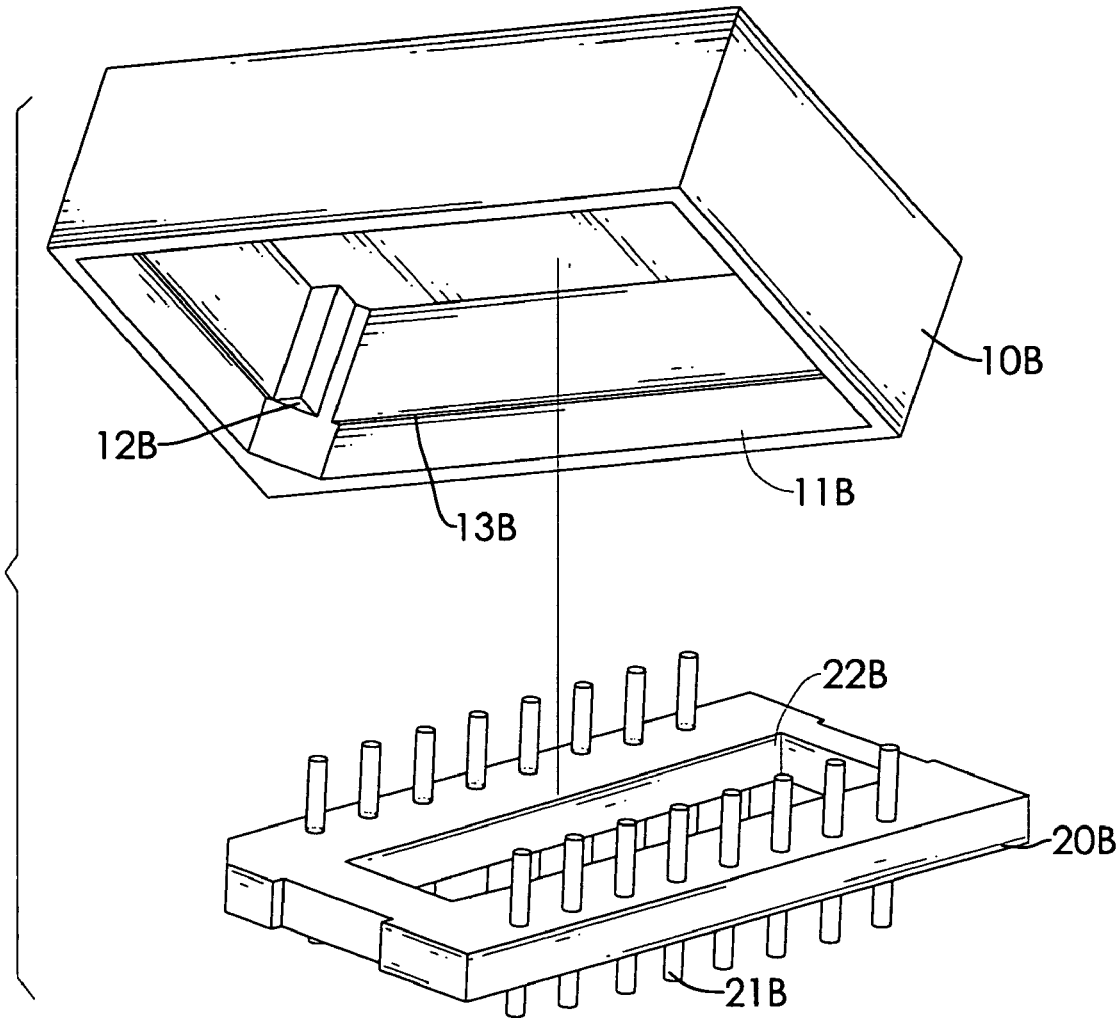
FIG. 4 is an exploded perspective view of a third embodiment of the transformer without coils in accordance with the present invention.

In a third embodiment of the transformer in accordance with the present invention, with reference to FIG. 4, the bobbin (20B) has 16 pins (21B).

Figure 5:
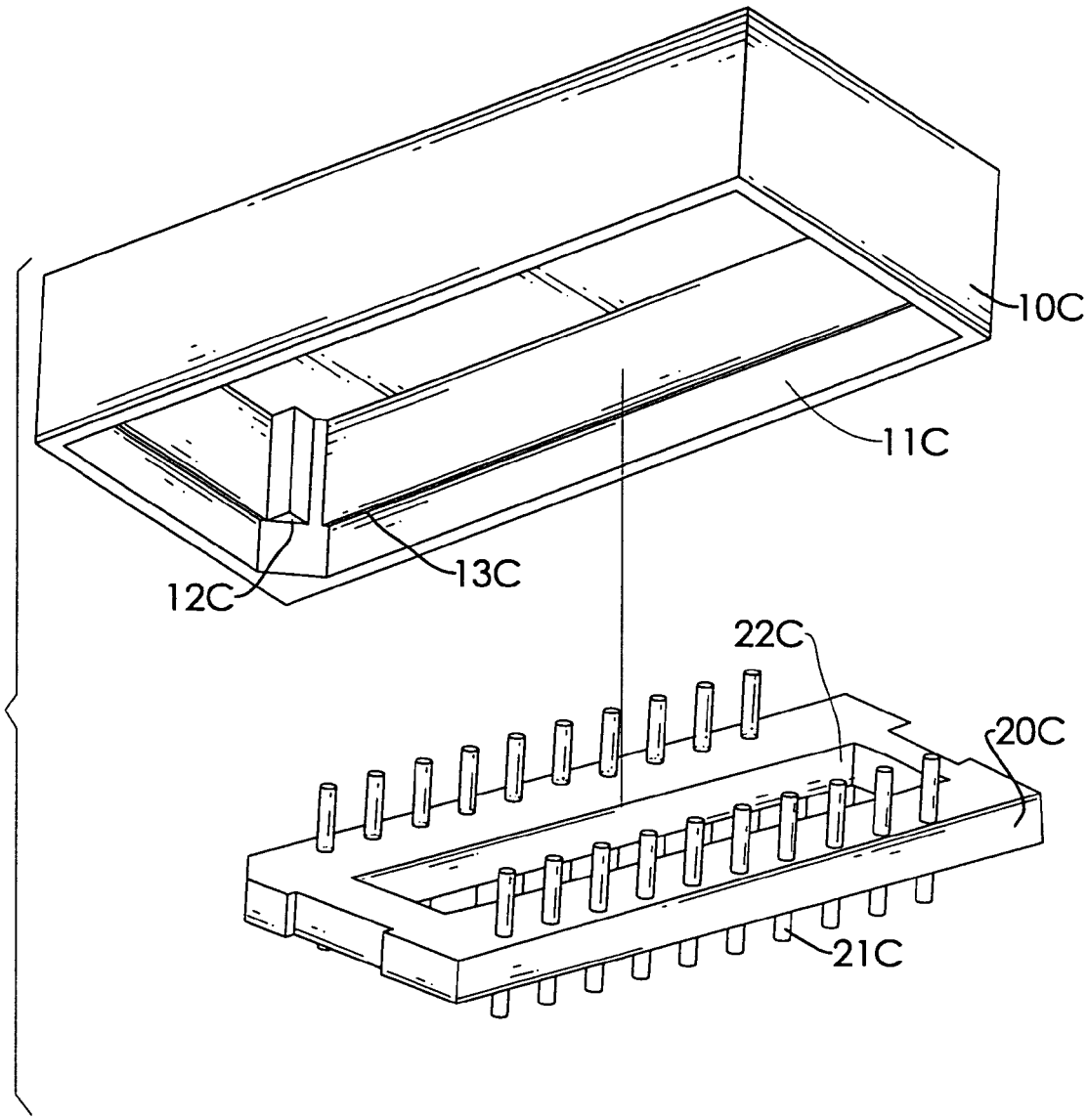
FIG. 5 is an exploded perspective view of a fourth embodiment of the transformer without coils in accordance with the present invention.
Figure 6:
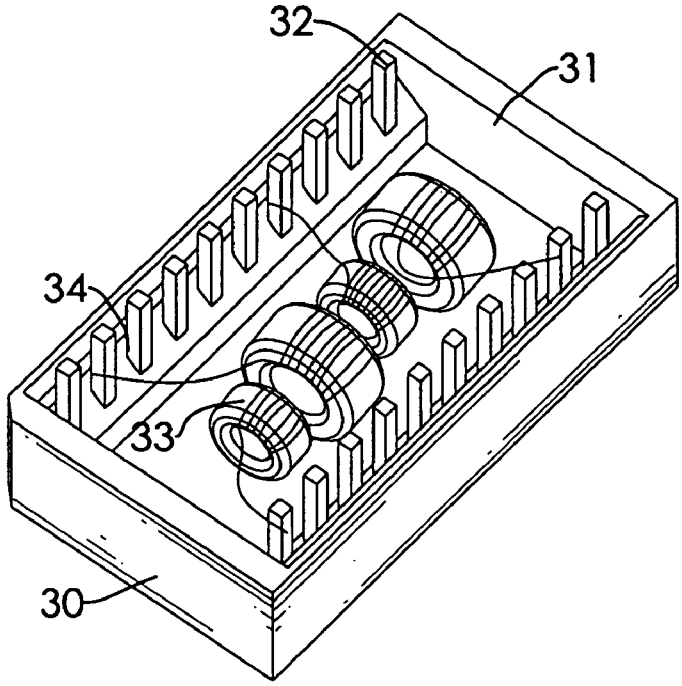
FIG.6 PRIOR ART
FIG. 6 is a perspective view of a first embodiment of a conventional transformer without encapsulant in accordance with the prior art.
Figure 7:
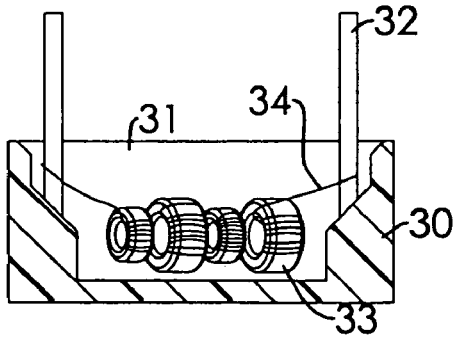
FIG.7 PRIOR ART
FIG. 7 is a cross section side view of the conventional transformer in FIG. 6.
Figure 8:
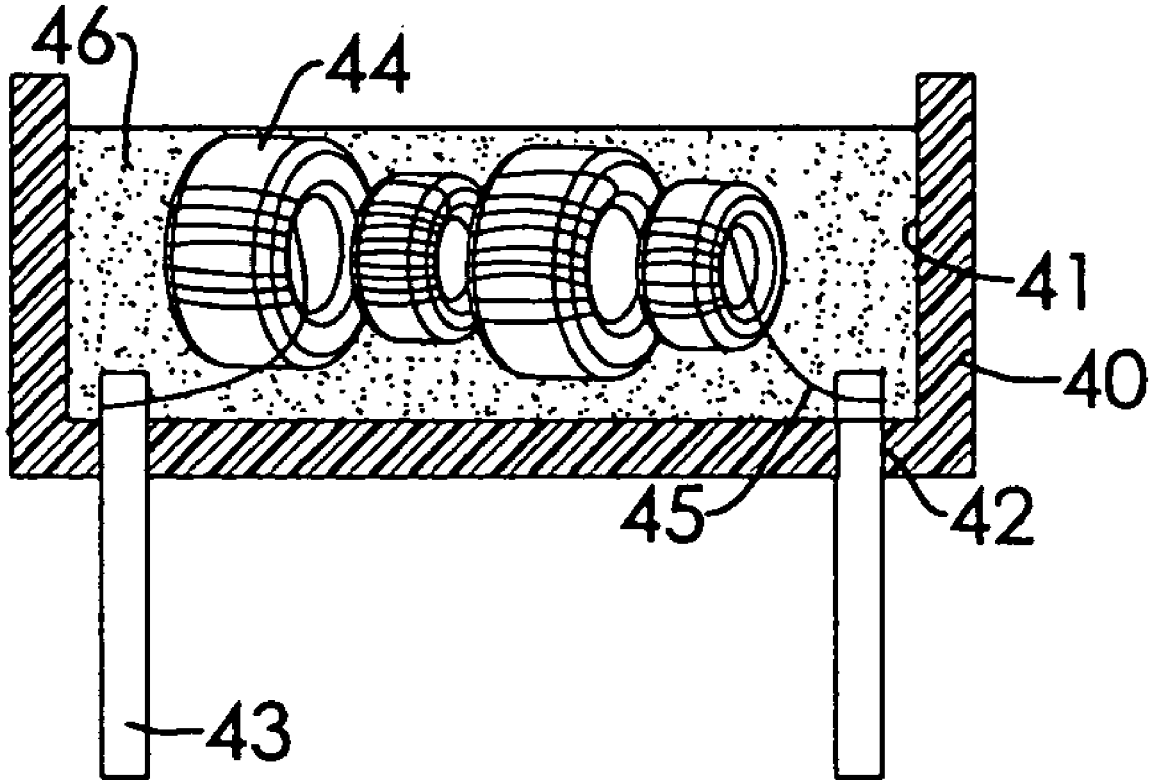
FIG.8 PRIOR ART
FIG. 8 is a cross section side view of a second embodiment of the conventional transformer with encapsulant in accordance with the prior art.

In a fourth embodiment of the transformer in accordance with the present invention, with reference to FIG. 5, the bobbin (20C) has 20 pins (21C).

The opening (22, 22A, 22B, 22C) is formed through the bobbin (20, 20A, 20B, 20C) between the pins (21, 21A, 21B, 21C).

The coils (23) are mounted on the bobbin (20) next to the opening (22) and have wires (24). The wires connect the coils (23) to the pins (21).

Consequently, the bobbin (20, 20A, 20B, 20C) with the coils (22) can be tested before the bobbin (20, 20A, 20B, 20C) is mounted in the cover (10, 10A, 10B, 10C). Any faults can be repaired before the bobbin (20, 20A, 20B, 20C) is mounted in the cover (10, 10A, 10B, 10C), which makes assembly of the transformer easier. Furthermore, the encapsulant may not be necessary so cost of fabricating transformers can be lower.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A transformer comprising a cover having a bottom;

a bottom opening formed on the bottom of the cover; and a cavity formed inside the cover, comminuting with the bottom opening of the cover and having inside walls;

at least one corner protrusion formed on at least one of the inside walls of the cavity; and at least one protruding edge formed on at least one of the inside walls of the cavity; and a bobbin mounted inside the cavity of the cover and having two surfaces;

engaging edges attaching respectively to the at least one corner protrusion of the cover and the at least one protruding edge of the cover;

multiple pins mounted through the bobbin and protruding from the two surfaces of the bobbin;

an opening formed through the bobbin between the pins; and multiple coils mounted on the bobbin next to the opening and having wires connecting the coils to the pins.

2. The transformer as claimed in claim 1, wherein the bobbin has 16 pins.

3. The transformer as claimed in claim 1, wherein the bobbin has 20 pins.

4. The transformer as claimed in claim 1, wherein the bobbin has 24 pins.

5. The transformer as claimed in claim 1, wherein the bobbin has 48 pins.

* * * * *